US011230816B1

(12) United States Patent
Craven et al.

(10) Patent No.: US 11,230,816 B1
(45) Date of Patent: Jan. 25, 2022

(54) APPARATUS AND METHOD FOR CONSTRUCTING COASTAL REVETMENT

(71) Applicant: Edgerton Contractors, Inc., Oak Creek, WI (US)

(72) Inventors: Jeremy Craven, Delafield, WI (US); Bruce Cornell, Kenosha, WI (US); Steven Tremmel, Rubicon, WI (US)

(73) Assignee: EDGERTON CONTRACTORS, INC., Oak Creek, WI (US)

( * ) Notice: Subject to any disclaimer, the term of this patent is extended or adjusted under 35 U.S.C. 154(b) by 0 days.

(21) Appl. No.: 17/096,033

(22) Filed: Nov. 12, 2020

(51) Int. Cl.
*E02B 3/12* (2006.01)

(52) U.S. Cl.
CPC ..... *E02B 3/121* (2013.01)

(58) Field of Classification Search
CPC combination set(s) only.
See application file for complete search history.

(56) References Cited

U.S. PATENT DOCUMENTS 4,201,494 A * 5/1980 Crowe ..... E02B 3/121 405/17
4,655,637 A 4/1987 Vignocchi
4,717,283 A 1/1988 Bach
4,790,690 A 12/1988 Vidal et al.
5,333,970 A * 8/1994 Heselden ..... E04C 1/395 405/286
7,033,115 B2 4/2006 Huang et al.
7,837,414 B2 * 11/2010 Heseldon ..... E02D 29/0208 405/284
8,262,318 B2 9/2012 Olsta et al.
10,113,285 B2 10/2018 Nadeau
2011/0033654 A1 * 2/2011 Walmsley ..... E02D 17/202 428/117
2016/0044899 A1 2/2016 Bartkowski
2017/0233965 A1 * 8/2017 Boasso ..... A01K 61/54 405/20

* cited by examiner

*Primary Examiner* — Kyle Armstrong
(74) *Attorney, Agent, or Firm* — Michael Best & Friedrich LLP

(57) ABSTRACT

A revetment construction apparatus includes a reusable plunger device and a pair of panels coupled with a movable joint. The plunger includes a box portion having an open bottom and a plurality of sides, including an open front side, a rear side opposite the front side, and a pair of spaced apart lateral sides extending between the front and rear sides. The plunger further includes a mast portion extending vertically upward from the box portion and providing at a top end thereof a picking cap for engagement by a construction machine. The panels include front and bottom panels extending, respectively, along the front and open bottom of the box portion. Each of the panels is a reinforced anti-erosion fabric panel coupled to the box portion with break-away fasteners configured to passively detach from the box portion upon lifting of the plunger after the box portion has been loaded with revetment foundation rock.

20 Claims, 9 Drawing Sheets

APPARATUS AND METHOD FOR CONSTRUCTING COASTAL REVETMENT

BACKGROUND

The invention relates to revetment construction along a shoreline of a body of water. More particularly, the invention relates to one or more pieces of construction apparatus and/or a process of using the same.

Revetments are sloped structures that may be constructed along a coastline to protect against erosion caused by waves, currents, etc. within the body of water. Revetments may be constructed of natural and/or manmade materials. Although a revetment may be at least partially above the surface of the water, it is typically required to perform working procedures under the surface of the water, which introduces complications associated with placing foundational elements of the revetment.

SUMMARY

In one aspect, the invention provides a revetment construction apparatus including a reusable plunger device and a pair of panels coupled with a movable joint. The reusable plunger device includes a box portion having an open bottom and a plurality of sides, including an open front side, a rear side opposite the front side, and a pair of spaced apart lateral sides extending between the front and rear sides. The reusable plunger device further includes a mast portion extending vertically upward from the box portion and providing at a top end thereof a picking cap for engagement by a construction machine. The pair of panels includes a front panel extending along the front side of the box portion and a bottom panel extending along the open bottom of the box portion. Each of the front and bottom panels is a reinforced anti-erosion fabric panel coupled to the box portion with breakaway fasteners configured to passively detach from the box portion upon lifting of the reusable plunger device after the box portion has been loaded with revetment foundation rock.

In another aspect, the invention provides a method of revetment construction including providing a reusable plunger device including a box portion and a mast portion extending upward from the box portion. The box portion is provided with an open bottom and a plurality of sides, including an open front side, a rear side opposite the front side, and a pair of spaced apart lateral sides extending between the front and rear sides. A sheet of anti-erosion fabric is provided, and the sheet is reinforced with a structural reinforcement layer to form a first reinforced fabric panel and a second reinforced fabric panel coupled with the first reinforced fabric panel by a movable joint. The first and second reinforced fabric panels are coupled to the reusable plunger device with breakaway fasteners such that the first reinforced fabric panel extends along the front side of the box portion and the second reinforced fabric panel extends along the open bottom of the box portion. The mast portion is engaged by a piece of construction equipment, which is manipulated to place the reusable plunger device, with the first and second reinforced fabric panels, into an underwater revetment trench so that the first and second reinforced fabric panels extend, respectively, along a side wall and a bottom wall of the underwater revetment trench.

DETAILED DESCRIPTION

Figure 3:
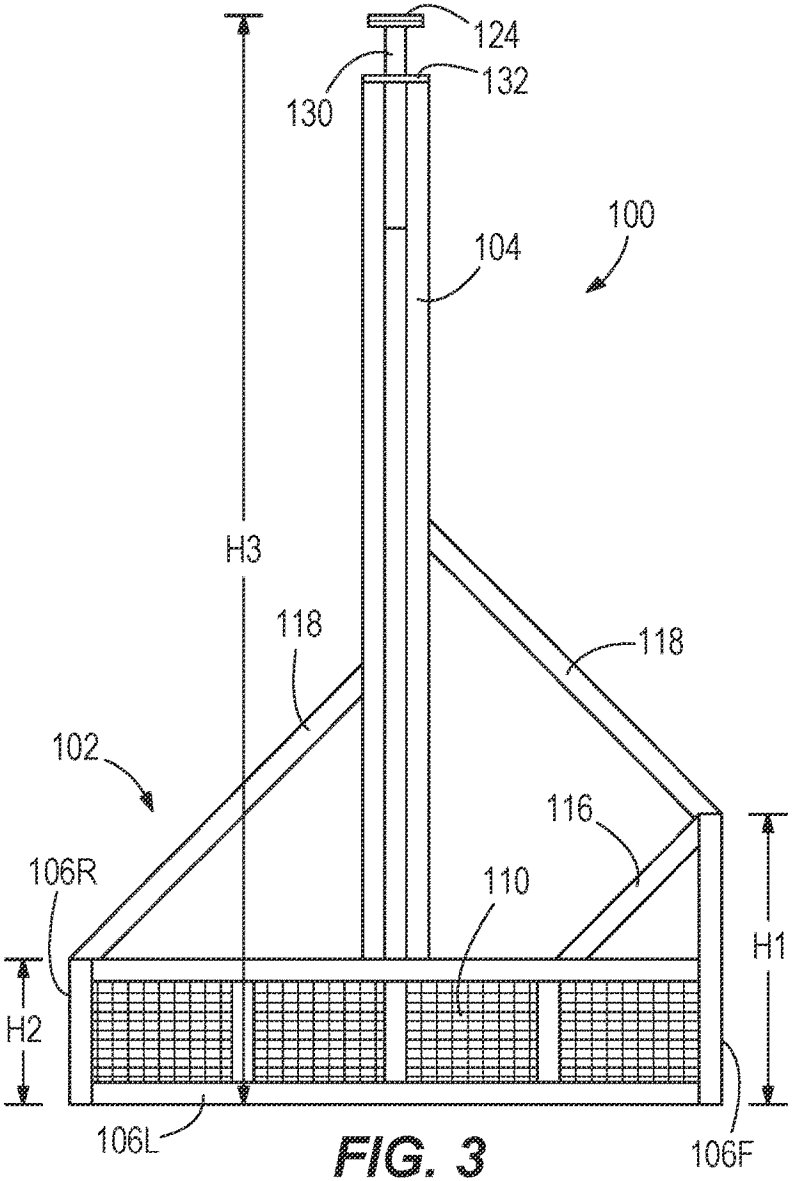
FIG. 3 is a side elevation view of the plunger box of FIG. 1.

FIGS. 1 to 4 illustrate a plunger box 100 that can be used in revetment construction according to the following description. For example, one or more of the plunger boxes 100 can be used to place and hold anti-erosion fabric within an underwater revetment trench for installation of rock that forms the revetment foundation. The plunger box 100 includes a lower box portion 102 and an upstanding mast portion 104. The lower box portion 102 is partly or fully bottomless, and is constructed in a rectangular shape with a front side 106F, a rear side 106R, and two lateral sides 106L. The lower box portion 102 is constructed from bars or beams (e.g., of metal), and screening grate material 110 is secured (e.g., by welding) along the rear and both lateral sides 106R, 106L. All the parts of the lower box portion 102, aside from the screening grate material 110, can be constructed from a single, uniform material stock, for example square metal tube of a given size and material (e.g., 4 inches by 4 inches, wall thickness of 0.250 inch), and the material may be a suitable grade of steel in some constructions. The parts of the lower box portion 102 can be joined by welding throughout. The front side 106F is left without such material 110 so as to define an opening 112 communicating the inside and outside of the lower box portion 102 through the front side 106F. The screening grate material 110 is configured to be water permeable while defining a containment compartment for containing rock fill of a prescribed size. As illustrated, beams forming the front side 106F are positioned exclusively at or above the uppermost beams forming the rear and lateral sides 106R, 106L. As such, the height of the front side 106F measured from the bottom of the plunger box 100 is greater than the height of the other sides 106R, 106L. For example, the front side 106F can extend up from the bottom to define a first height H1 that is at least 1.5 times, or at least 2.0 times, the second height H2 defined by the other sides 106R, 106L (FIG. 3). In one example, the front side 106F defines a first height H1 of 4 feet, and the other sides 106R, 106L terminate at a second height H2 of 2 feet. The mast portion can extend to a third height H3 that is at least 2.0 time the first height H1, or at least 3.0 times the first height H1. Box corner braces 116 can be provided, for example at a 45-degree angle (FIG. 3), between the top of the front side 106F and the top of the respective lateral sides 106L. Furthermore, mast braces 118 can be provided between the mast portion 104 (e.g., at an intermediate height thereof) and one, two, or more sides of the lower box portion 102 (e.g., connecting at the top edges of the front and rear sides 106F, 106R). The mast braces 118 may also be oriented at a 45-degree angle with respect to the vertical mast portion 104 and the horizontal top edges along the lower box portion 102 to which they are connected at respective ends. Some or all of the braces 116, 118 can be constructed of the same material stock as that used throughout the lower box portion 102.

A bottom portion of the mast 104 is secured to one or more crossbeams 120 that traverse the lower box portion 102. For example, the crossbeams 120 can extend between respective central portions of the two lateral sides 106L. The crossbeams 120 subdivide the interior of the lower box portion 102 into separate compartments, including a rear compartment adjacent the rear side 106R and a front compartment that is exposed to the front opening 112. The mast 104 can comprise a plurality of elongate beams in parallel arrangement (e.g., four vertical beams placed in spaced relation with one another in a rectangular pattern). The beams forming the mast 104 can be constructed of the same material stock as that used throughout the lower box portion 102 and/or the braces 116, 118. An additional internal mast brace 118A can be provided within the central portion of the mast 104, between individual adjacent vertical mast members. The internal mast brace 118A is positioned at or adjacent a height position at which the mast braces 118 are attached to the mast 104 for resisting buckling of the mast 104 due to large lateral loads imparted from the braces 118. An upper portion of the mast 104 terminates at a picking cap 124 for engagement by a piece of construction equipment such as the illustrated bucket 128 of FIG. 2. In practice, the plunger box 100 can be manipulated by a backhoe, an excavator, a crane, or other practical means of construction equipment that may be on site for the revetment project. The picking cap 124 can be positioned atop a picking pin 130, for example a solid metal pin of circular cross-section, that extends vertically above the primary mast beams. The picking pin 130 can be exposed between the picking cap 124 and a picking plate 132. The picking pin 130 can have a transverse dimension (e.g., diameter) sized to fit between adjacent teeth of the bucket 128 and to rest against the bucket frog, for example a diameter of 3.5 inches in one exemplary embodiment. At least the picking cap 124 and the picking pin 130 constitute a lifting structure for use by construction equipment to lift the plunger box 100 and place it at least partially under water into a revetment trench as will be described in further detail below. The cross-section shape of the picking pin 130 is devoid of flats or edges so as to enable the plunger box 100 to be turned about a central axis through the pin 130 when lifted by the construction equipment, which can aid in setting a necessary orientation for installation.

Figure 1:
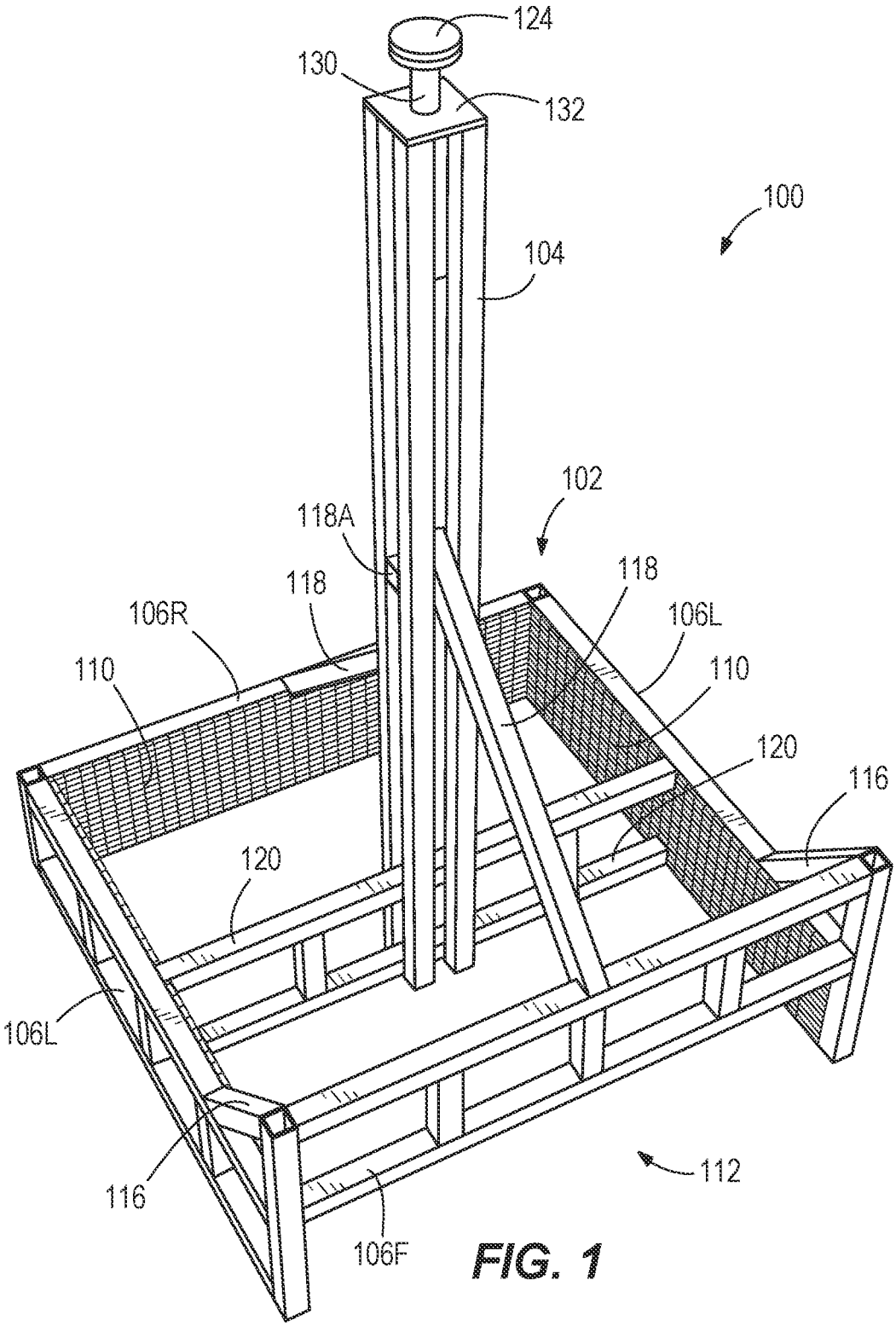
FIG. 1 is a perspective view of a plunger box according to one embodiment of the present invention.
Figure 2:
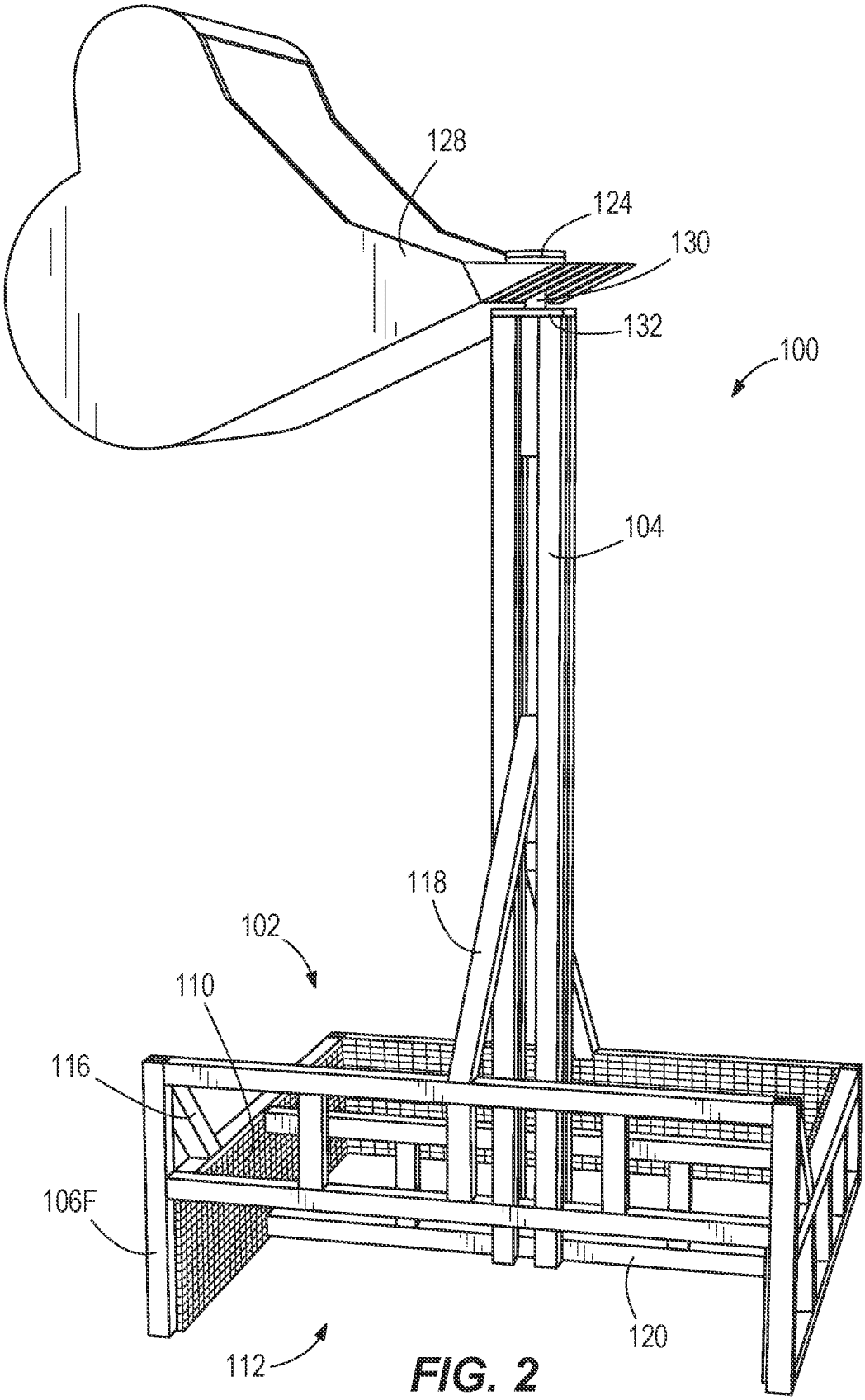
FIG. 2 is an alternate perspective view of the plunger box of FIG. 1 engaged by a bucket of a piece of construction equipment.
Figure 4:
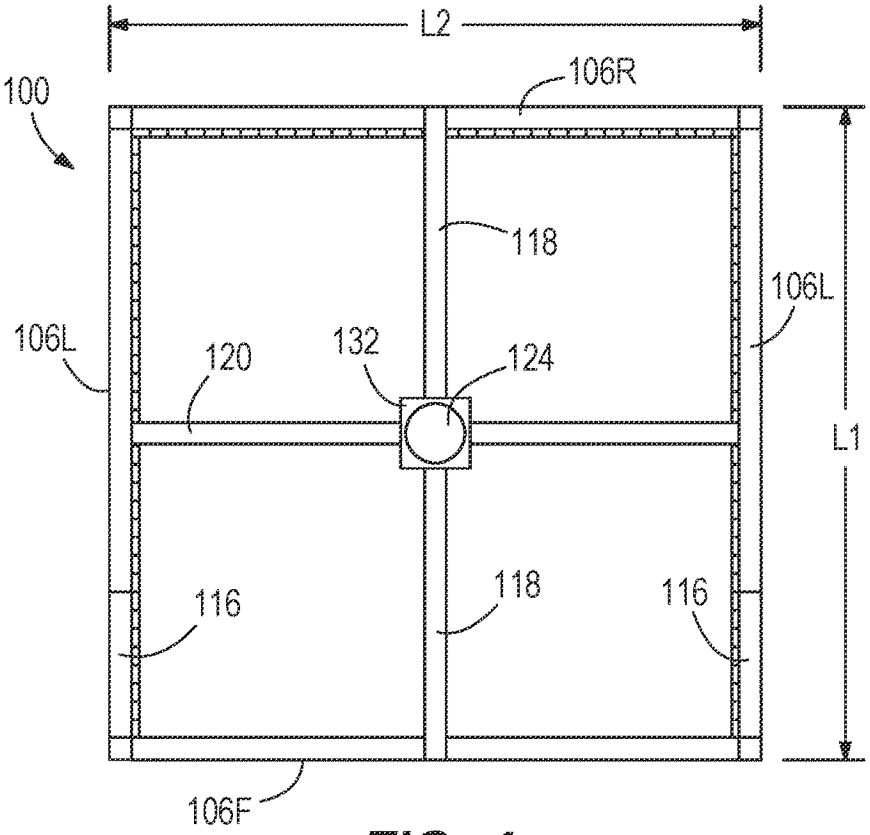
FIG. 4 is a top plan view of the plunger box of FIG. 1.

As can be seen in the top view of FIG. 4, the lower box portion 102 is shaped as a rectangle, and particularly one with four sides of equal length to form a square profile. Each side of the lower box portion 102 can be 6 feet long or greater (e.g., 9 feet), and the size can be determined as a function of revetment trench base width. As referred to herein, the lower box portion 102 defines a front-to-back length L1 and a side-to-side length L2. These lengths L1, L2 can be equal or unequal. Each of the lengths L1, L2 can be greater than the first height H1, or at least greater than the second height H2. In the illustrated construction, each of the lengths L1, L2 is at least 2.0 times the first height H1.

Figure 5:
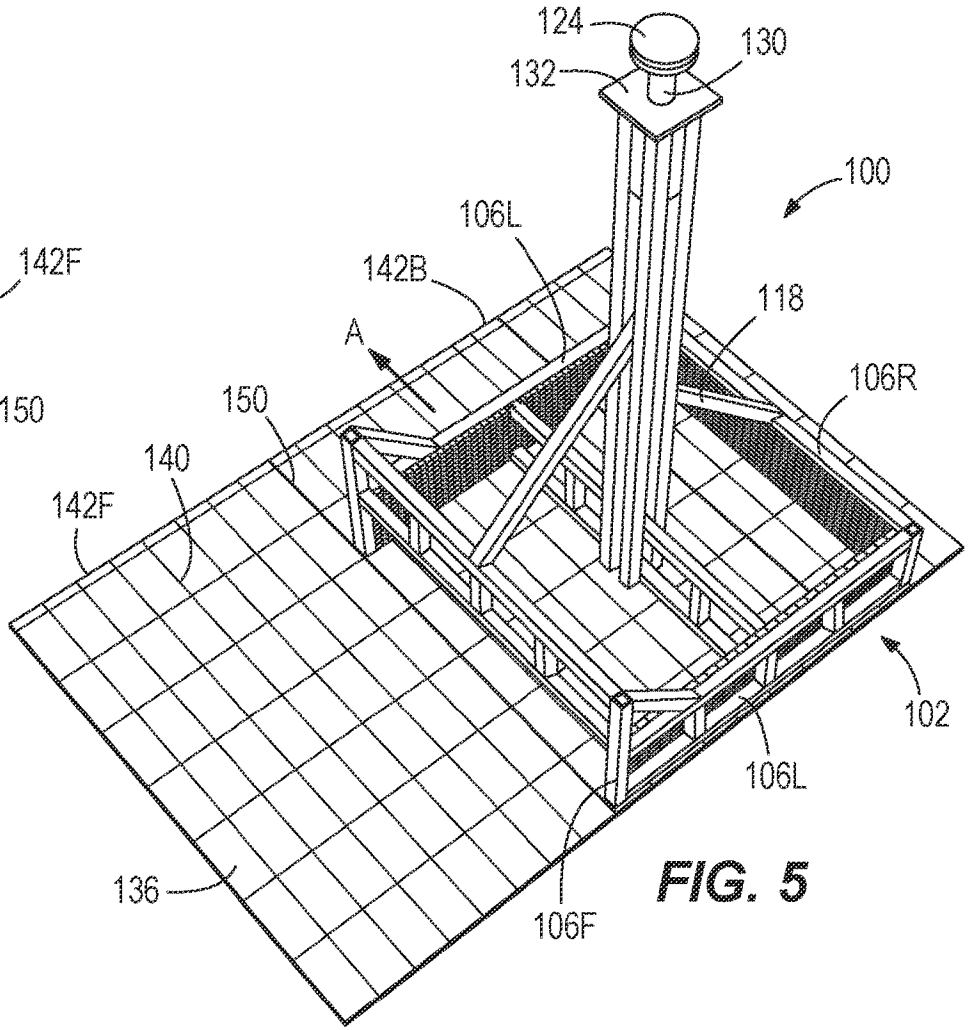
FIG. 5 is a perspective view of a water-side plunger box during assembly with a strip of fabric and two wire mesh panels on which the fabric strip is mounted.
Figure 6:
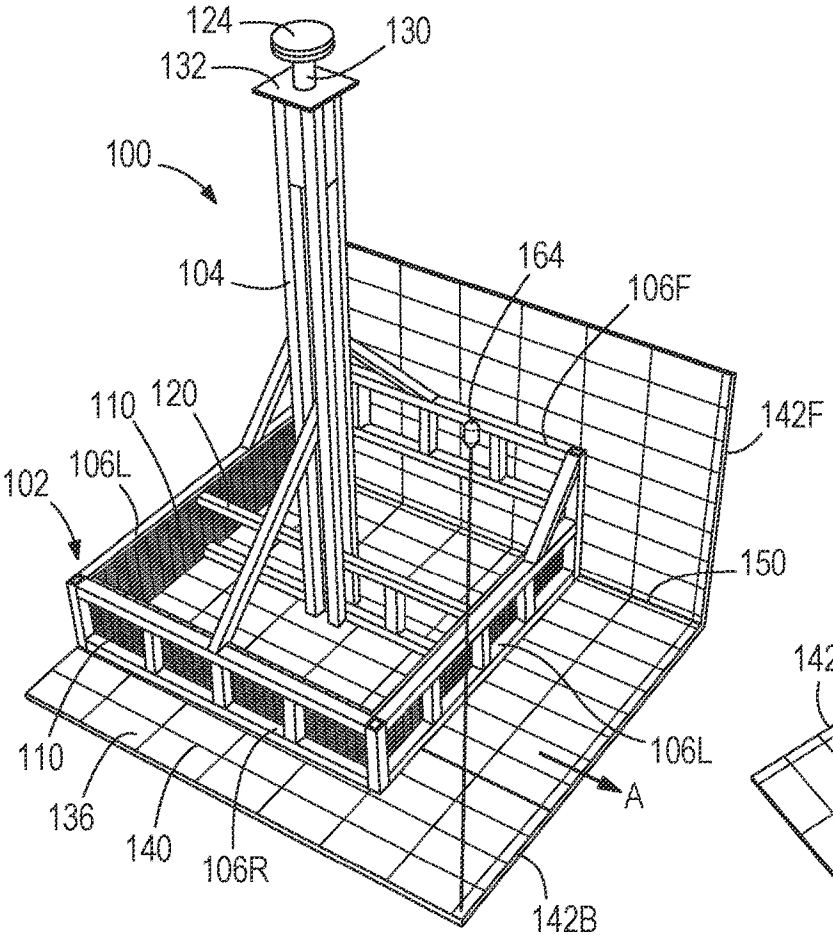
FIG. 6 is a perspective view of the water-side plunger box of FIG. 5 following the upward folding of a front one of the two wire mesh panels.
Figure 7:
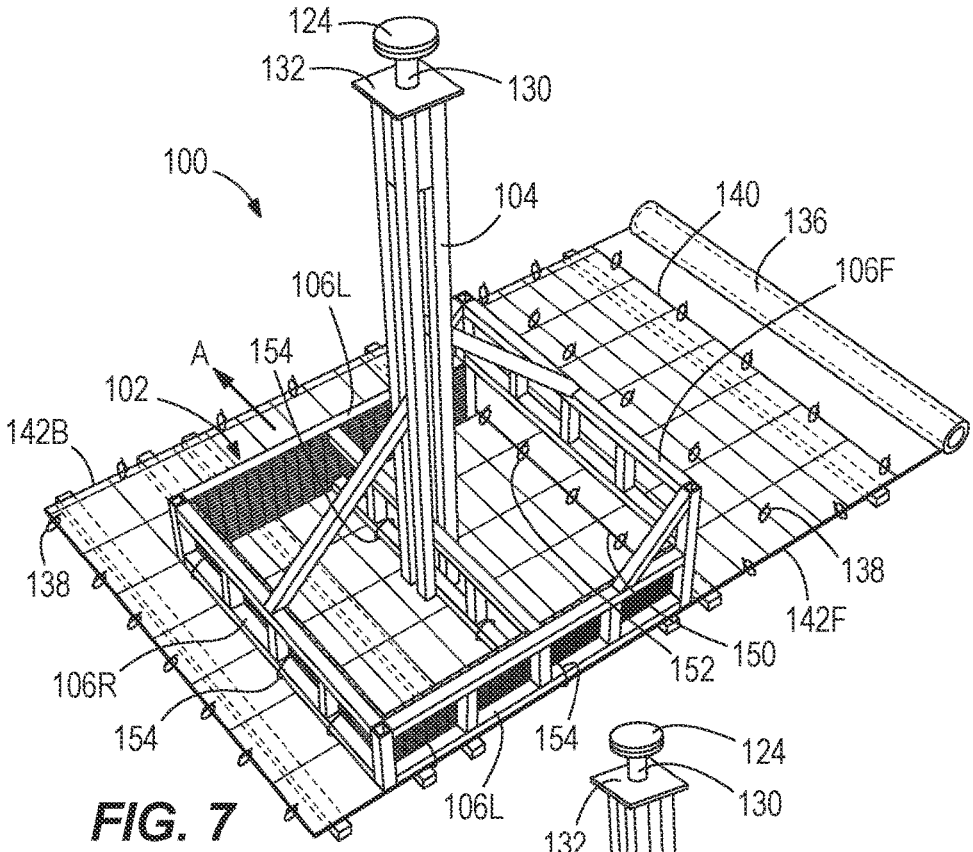
FIG. 7 is a perspective view of a land-side plunger box during assembly with a roll of fabric and two wire mesh panels on which a portion of the roll of fabric is mounted.
Figure 8:
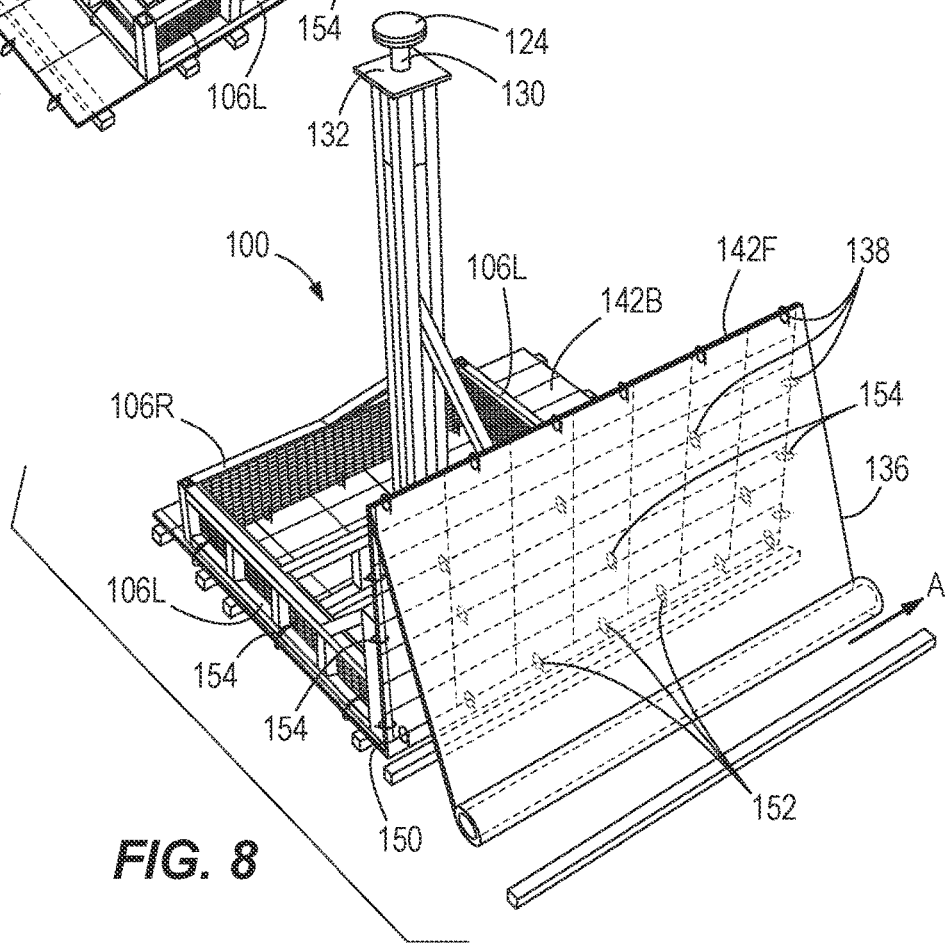
FIG. 8 is a perspective view of the land-side plunger box of FIG. 7 following the upward folding of a front one of the two wire mesh panels.

According to the following description, the plunger box 100 provides a reusable revetment construction apparatus. As a first function thereof, the plunger box 100 acts as a installation tool for the placement and temporary retention of anti-erosion fabric sheeting material on the bottom of the revetment trench. Although steps of an exemplary construction procedure are explained further below, the equipment preparation utilizing two of the plunger boxes 100 is first described with respect to FIGS. 5-8. FIGS. 5 and 6 illustrate a first plunger box 100 prepared for use on a "water-side" of the revetment trench, while FIGS. 7 and 8 illustrate a second plunger box 100 prepared for use on a "land-side" of the revetment trench. With brief reference to FIG. 9, the water-side is the side of the trench to the left side, furthest from the shoreline, while the land-side is the side of the trench to the right side, adjacent the shoreline. As shown in FIGS. 5 and 6, a sheet of geotextile fabric 136 is provided to be attached at least partially underneath the plunger box 100. The fabric sheet 136, which may be a single, continuous strip, can have dimensions exceeding those of the lower box portion 102 in top view so that the fabric sheet 136 covers the entire area directly under the lower box portion 102 and also extends outwardly therefrom on at least two or three sides. As shown, the fabric sheet 136 has a large overhang from the lower box portion 102 to the front side 106F, and also has smaller overhangs to the rear side 106R and one lateral side 106L (in lateral direction A). As will become more apparent from the following description, the direction A is defined as a revetment construction direction, with respect to the length of the trench. For the water-side plunger box 100 of FIGS. 5 and 6, the direction A is to the left when viewing the plunger box 100 from the front.

The fabric sheet 136, which by itself may not have the rigidity required to maintain planar form during use such as movement under water, is reinforced by an attached structural reinforcement layer 140. In some constructions, the structural reinforcement layer 140 is provided by welded wire mesh panels of crisscross metal wires. Although other types of reinforcement may be substituted, the cost and amount of material may generally be minimized as it is merely a means to facilitate the installation of the material of primary interest, which is the fabric sheet 136. The structural reinforcement layer 140 and the fabric sheet 136 can be attached together by suitable fasteners such as wire ties 138 in a number and arrangement sufficient to hold the fabric sheet 136 into the shape of the structural reinforcement layer 140. In some constructions, the fasteners that hold the fabric sheet 136 to the reinforcement layer 140 are cable ties, or "zip ties." As implemented, the reinforcement layer 140 is divided into two separate sections such that a multi-panel assembly of reinforced fabric can be provided, including a front panel 142F and a bottom panel 142B. The front and bottom panels 142F, 142B are movably or hingedly coupled together at a hinge 150. The hinge 150 can be, but need not be, formed with a conventional or off-the-shelf hinge mechanism or hardware. Rather, the hinge 150 can be formed by a plurality of loosely fixed fasteners such as wire ties 152. The front panel 142F is configured to be swingable or pivotable with respect to the bottom panel 142B so that it can be folded upwardly from the orientation of FIG. 5 to the orientation of FIG. 6 in which it extends upward vertically along the front side 106F. As assembled and folded, the hinge 150 extends along the bottom edge of the front side 106F where the opening 112 is formed. The front and bottom panels 142F, 142B can be temporarily secured to the plunger box 100, e.g., by a plurality of fasteners such as wire ties 154. The wire ties 154 form breakaway fasteners, each of which is twisted in a configuration that is adapted to untwist and slip apart under a prescribed weight or tensile force. As shown in FIG. 6, the first section of the reinforcement layer 140 enables the front reinforced fabric panel 142F to extend upward beyond the top edge of the front side 106F of the lower box portion 102, and the second section of the reinforcement layer 140 enables the bottom reinforced fabric panel 142B to extend rearward beyond the rear side 106R of the lower box portion 102. The front reinforced fabric panel 142F may extend upward beyond the top edge of the front side 106F by at least half the height thereof H1 (e.g., or by the full height H1). The bottom reinforced fabric panel 142B may extend rearward beyond the rear side 106R by at least half the height H2 thereof (e.g., or by the full height H2). Both panels 142F, 142B extend beyond the lower box portion 102 in the lateral construction direction A.

As shown in FIGS. 7 and 8, preassembly of the second plunger box 100 with front and bottom reinforced fabric panels 142F, 142B for the land-side is very similar to that of the first plunger box 100 of FIGS. 5 and 6. In particular, the reinforced fabric panels 142F, 142B are constructed in generally the same way as those of FIGS. 5 and 6 to include the two separate sections of structural reinforcement layer 140 along with the fabric sheet 136. The structural reinforcement layer 140 and fabric sheet 136 can be attached by suitable fasteners such as wire ties 138 in a number and arrangement sufficient to hold the fabric sheet 136 into the shape of the structural reinforcement layer 140. The panels 142F, 142B are coupled via a hinge 150, and this can be carried out by a plurality of loosely fixed wire ties 152 so that the hinge 150 allows the front panel 142F to be folded upwardly from the orientation of FIG. 7 to the orientation of FIG. 8 in which it extends upward vertically along the front side 106F of the land-side plunger box 100. The front and bottom panels 142F, 142B can be temporarily secured to the plunger box 100, e.g., by a plurality of loosely fixed wire ties 154. As shown in FIG. 8, the front reinforced fabric panel 142F extends upward beyond the top edge of the front side 106F of the lower box portion 102, and the bottom reinforced fabric panel 142B extends rearward beyond the rear side 106R of the lower box portion 102. In a key difference from the water-side assembly of FIGS. 5 and 6, both panels 142F, 142B on the land-side plunger box 100 of FIGS. 7 and 8 extend beyond the lower box portion 102 (in the lateral construction direction A) to the right when viewed from the front, as the water-side and land-side plunger boxes 100 are put into use in a back-to-back arrangement in which the rear sides 106R are placed adjacent each other. The orientations with respect to the direction A, for both the water-side and land-side plunger boxes 100 assumes that the construction procedure is carried out from left to right as viewed from the land toward the water. If working to construct the revetment along the opposite lengthwise direction of the trench, then the direction A, and associated fabric overhang, is reversed for both plunger boxes 100 such that they will still be set up dissimilarly from one another. The other key difference with the assembly of FIGS. 7 and 8 is that the front side panel 142F has both a reinforced section of the fabric sheet 136 and also an extended, unreinforced section of the fabric sheet 136 connected thereto. The fabric sheet 136, including the reinforced and unreinforced sections, can be continuous portions of a single roll of fabric sheeting. In some constructions, the unreinforced section can extend 30 feet or more, and in some cases 40 feet or more. This extra fabric is configured to be extended up the backslope of the trench on the land-side.

Figure 9:
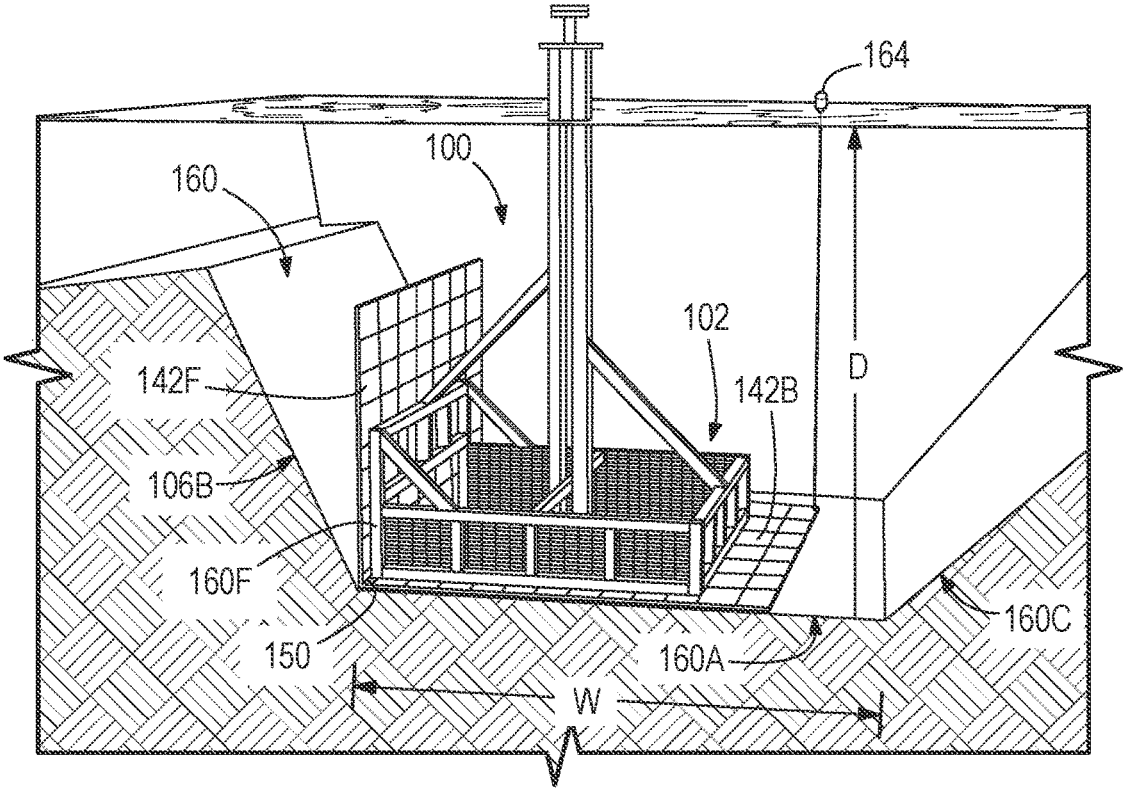
FIG. 9 is a perspective view illustrating placement of the water-side plunger box, with the folded wire mesh panels and attached fabric strip, into an underwater trench formed along a coastline.

An exemplary procedure for the use of the plunger boxes 100 is described with reference to the sequential views of FIGS. 9 to 13. Prior to the placement of the first water-side plunger box 100 as shown in FIG. 9, the trench 160 is created in the sub-aqueous earth floor along the edge of the body of water. The trench 160 has a length (into the page) and a cross-section shape taken perpendicular to the length, the cross-section shape including a base or bottom wall 160A, a non-vertical water-side side wall 160B extending upward from the bottom wall 160A at a sloped angle, and a non-vertical land-side side wall 160C extending upward from the bottom wall 160A at a sloped angle, which may be the same as or different than the angle on the water-side. Between the side walls 160B, 160C, the bottom wall 160A has a width W. At the initial stages of construction, as shown in FIG. 9, the width W may be narrower than the final dimension. In other words, the width W may be extended following placement of the first water-side plunger box 100. In some constructions, the initial trench width W at the time of placing the first plunger box 100 can be at least 1.3 times the corresponding plunger box width (e.g., at least 12 feet for a plunger box with a 9-foot lower box portion 102). Before, during, or after excavation of the revetment trench 160, one or more of the water-side and land-side plunger boxes 100 can be prepared with the reinforced fabric panels 142F, 142B as described above and shown in FIGS. 6 and 8. This includes hinging the panels together (e.g., via the wire ties 152), making connections (e.g., via wire ties 138) between the fabric sheet 136 and the reinforcement layer 140, and also making connections (e.g., via wire ties 154) between the panels 142F, 142B and the plunger box 100.

A piece of construction equipment, in particular a piece of heavy earth-moving equipment such as an excavator or backhoe, is positioned adjacent the trench 160, for example on a level working bench of earth positioned adjacent a top end of the land-side trench side wall 160C. By manipulation of the construction equipment (e.g., the bucket 128 engaging the picking cap 124 and the picking pin 130), the first water-side plunger box 100 is picked up from a staging area along the shoreline. If necessary, the first water-side plunger box 100 is rotated about its central axis, for example by engagement of a second piece of construction equipment, to set a proper orientation. Then, by further manipulation of the construction equipment, the first water-side plunger box 100 is submerged and placed into the trench 160 as shown in FIG. 9 such that the hinge 150 between the front and bottom panels 142F, 142B is positioned at the outside "toe" where the water-side side wall 160B meets the bottom wall 160A. The lateral construction direction A is to right when looking toward the water-side side wall 160B (i.e., or generally into the page as viewed in FIG. 9). The portion of the bottom panel 142B that protrudes from the lower box portion 102 extends along the bottom trench wall 160A toward the land-side side wall 160C. At the rearmost edge of the bottom reinforced fabric panel 142B, and furthest toward the lateral construction direction A, a buoy 164 can be strung on a line approximately equal to the depth D of the bottom trench wall 160A below the water surface. The buoy 164 is strung prior to placement of the plunger box 100 into the trench 160 and serves as a visual locator or point of reference for an above-ground construction equipment operator during further procedures described below. In practice, the buoy 164 can have an extended vertical length and correspondingly reduced attachment line with respect to the illustrated embodiment. For example, to resist movement by waves within the water, the buoy 164 can be elongated to have a length of at least 3 feet, at least 4 feet, or at least 6 feet (e.g., 1.5 times the expected wave height). The construction equipment can be disengaged from the first water-side plunger box 100 once positioned as shown in FIG. 9.

Figure 10:
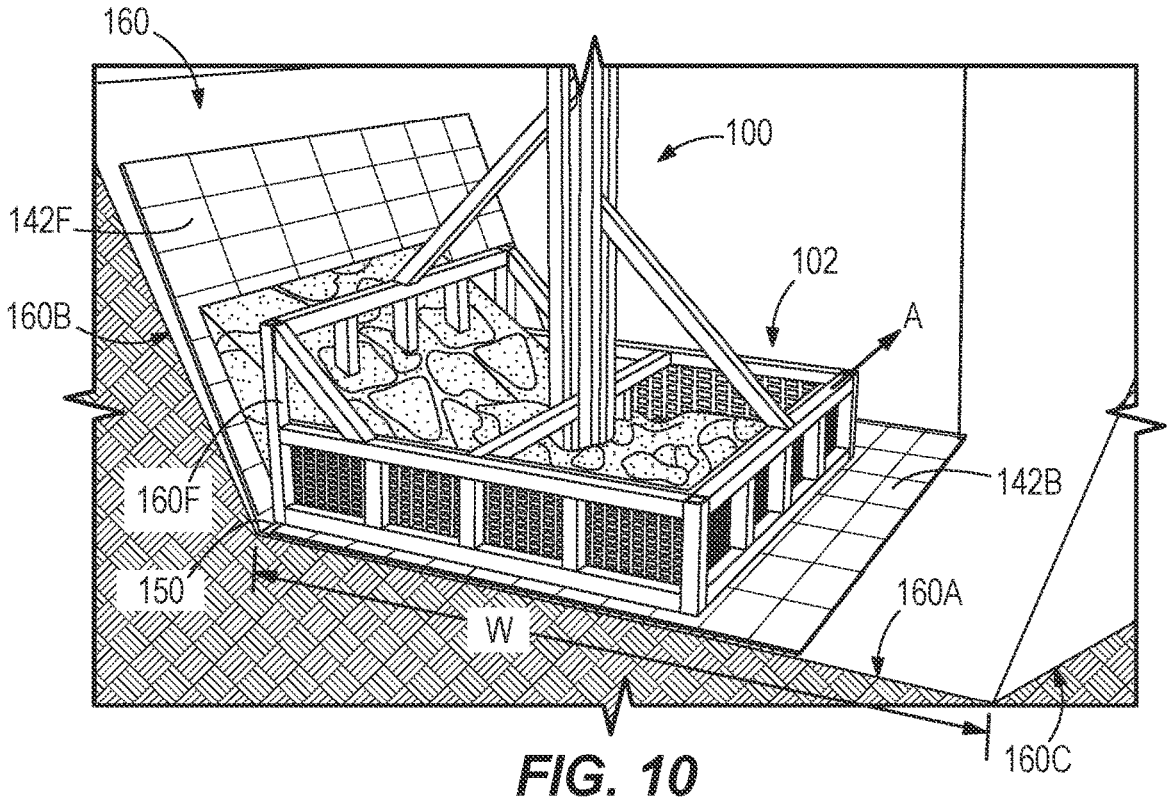
FIG. 10 is a perspective view illustrating the water-side plunger box, following partial unfolding of the front wire mesh panel against a side slope of the trench and initial loading of rock into the plunger box atop the fabric strip.

One or more loads of revetment foundation rock are then loaded into the lower box portion 102 of the first water-side plunger box 100 as shown in FIG. 10. First, the bucket 128 can be filled with a load of rock from a nearby supply (e.g., 4-inch to 10-inch filter stone). The material makeup of the rock can be natural or manmade, as specified for the particular revetment project. The bucket 128 is then positioned against the top portion of the front reinforced fabric panel 142F, which is still vertical or upright and spaced away from the water-side trench side wall 160B. The bucket 128 is manipulated to urge the front reinforced fabric panel 142F against the water-side trench side wall 160B, breaking the connection temporarily provided by the wire ties 154 to the front side 106F of the lower box portion 102. In practice, the wire ties 154 may unwind, become severed, or a combination of these breakaway means to allow the front panel 142F to release from the lower box portion 102. The bucket 128 is then manipulated to dump all or part of the rock on the front reinforced fabric panel 142F, for example while still holding the top of the front reinforced fabric panel 142F against the water-side trench side wall 160B. The rock dropped here settles and builds up at and around the toe of the trench where the walls 160A, 160B meet. Some of the rock also enters the front compartment of the lower box portion 102 through the front opening 112. If less than all of the first load of rock is put into the front part of the lower box portion 102, a remaining portion can be placed from the bucket 128 into the other (rear) part of the lower box portion 102, rearward of the crossbeam 120. The weight of the first load of rock bears down on both of the reinforced fabric panels 142F, 142B, and not on the plunger box 100, which is bottomless. One or more additional loads of rock can then be placed into the lower box portion 102 so that it becomes mostly or completely full, though not overflowing.

Figure 11:
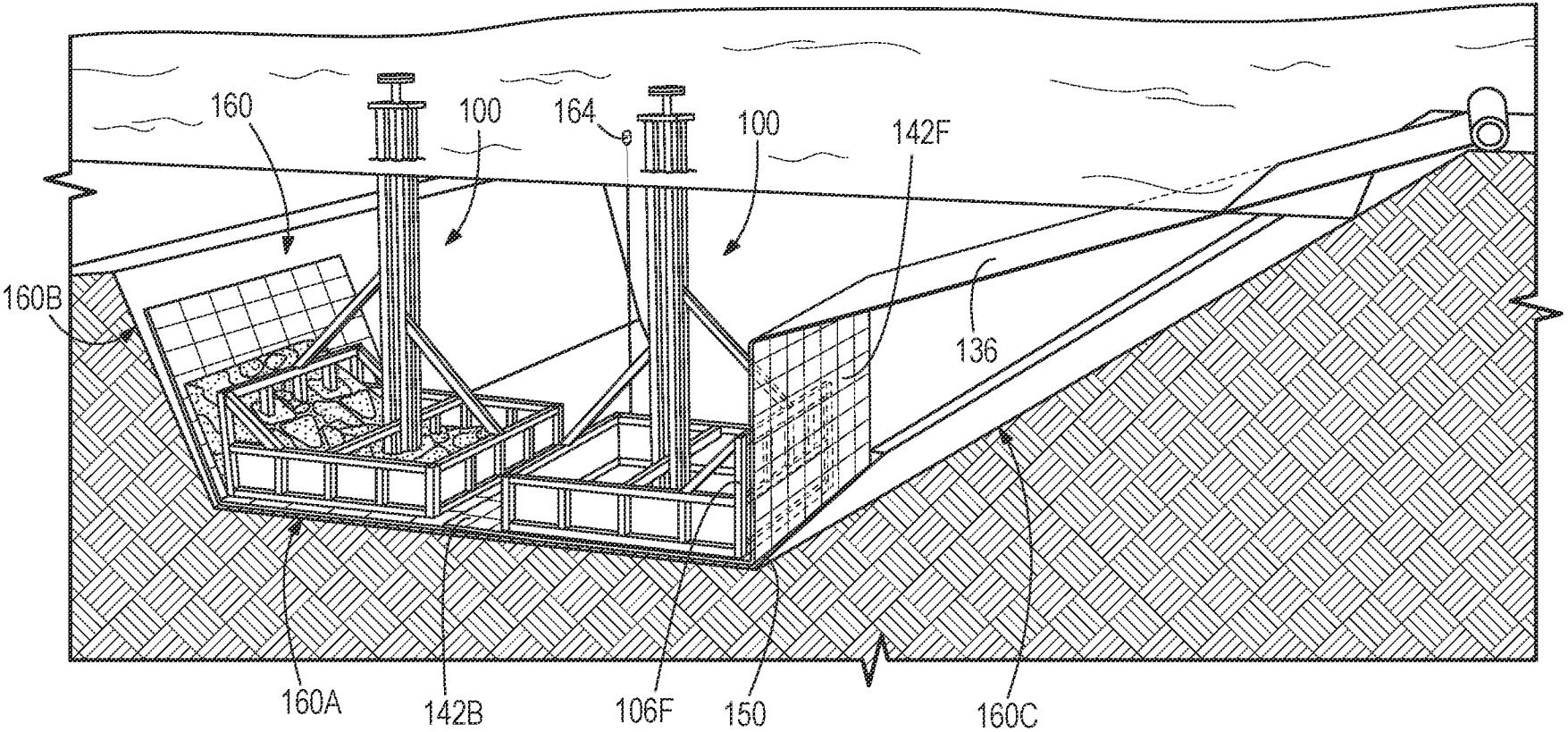
FIG. 11 is a perspective view illustrating placement of the land-side plunger box, with the folded wire mesh panels and attached fabric roll, into the underwater trench adjacent the water-side plunger box.

With both panels 142F, 142B of the first water-side plunger box 100 in final position, and with the plunger box 100 still in position in the trench 160, the revetment construction moves on as follows. Prior to placement of the first land-side plunger box 100, the trench width W may be expanded by further excavation, e.g., to the final design subgrade. The above-water working bench for the earth-moving equipment may also be widened at this stage of the procedure. The first land-side plunger box 100 with the attached front and rear reinforced fabric panels 142F, 142B is then picked up by the equipment, e.g., engaged by the bucket 128. The first land-side plunger box 100 is placed in line with the already placed water-side plunger box 100 as shown in FIG. 11, in particular directly in front of the water-side plunger box 100 as viewed from the land toward the water. The buoy 164 may provide a visual guide for placing the first land-side plunger box 100. The first land-side plunger box 100 is placed with an orientation that is reversed from that of the water-side plunger box 100 such that the respective rear sides 106R face each other. As such, the outwardly projecting portions of the respective bottom panels 142B can overlap along the trench bottom wall 160A. Furthermore, the land-side plunger box 100 is positioned so that the attached front panel 142F of reinforced fabric is in facing relation with the land-side trench side wall 160C. The hinge 150 between the front and bottom panels 142F, 142B on the land-side plunger box 100 is placed at the edge where the trench bottom wall 160A meets the land-side trench side wall 160C. As the first land-side plunger box 100 is put into place, the length of fabric 136 extending from the front panel 142F can be maintained outside the trench 160, e.g., above the water on or adjacent the working bench. This length of fabric 136, which may include a roll of excess fabric, can be handled by one or more workers.

Figure 12:
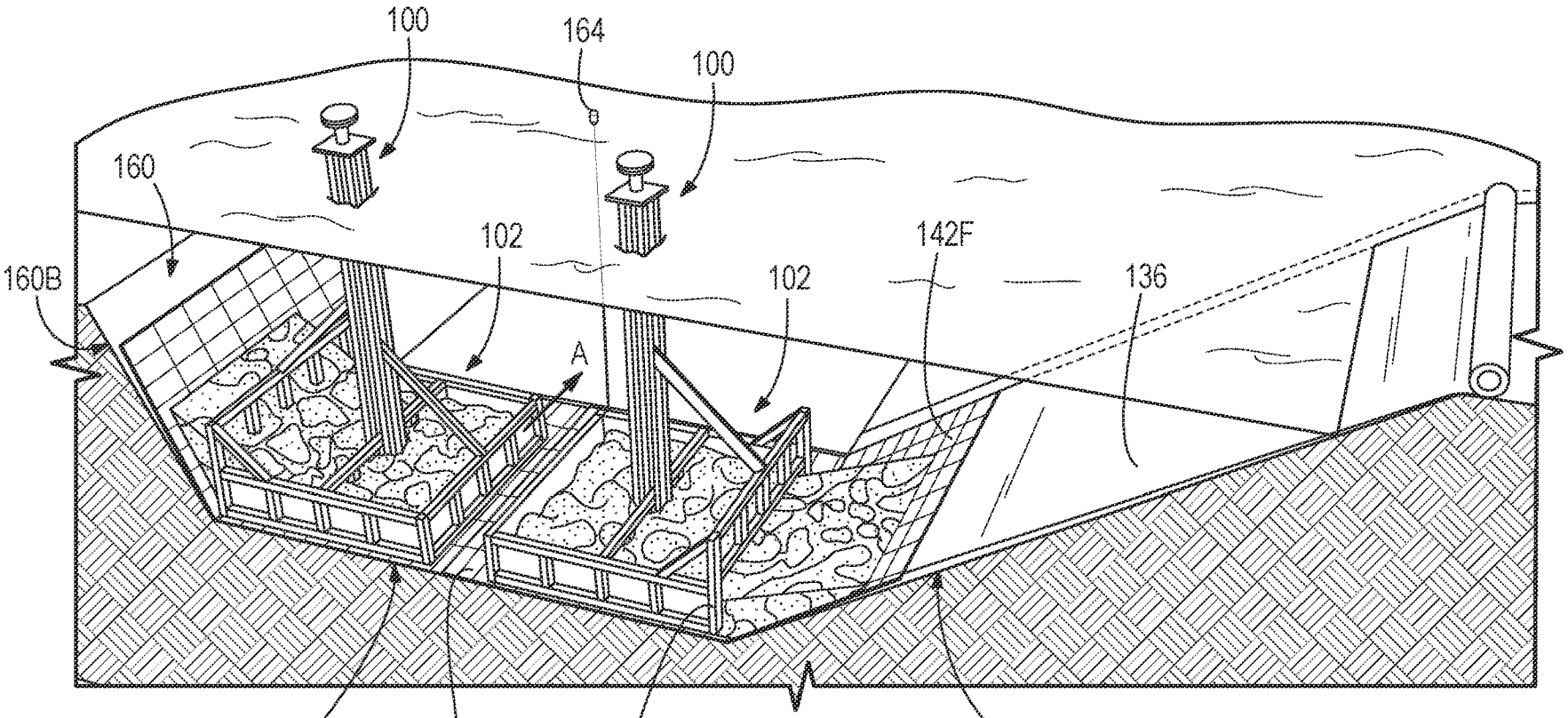
FIG. 12 is a perspective view illustrating the land-side plunger box, following partial unfolding of the front wire mesh panel against a side slope of the trench and initial loading of rock into the plunger box atop the fabric.
Figure 13:
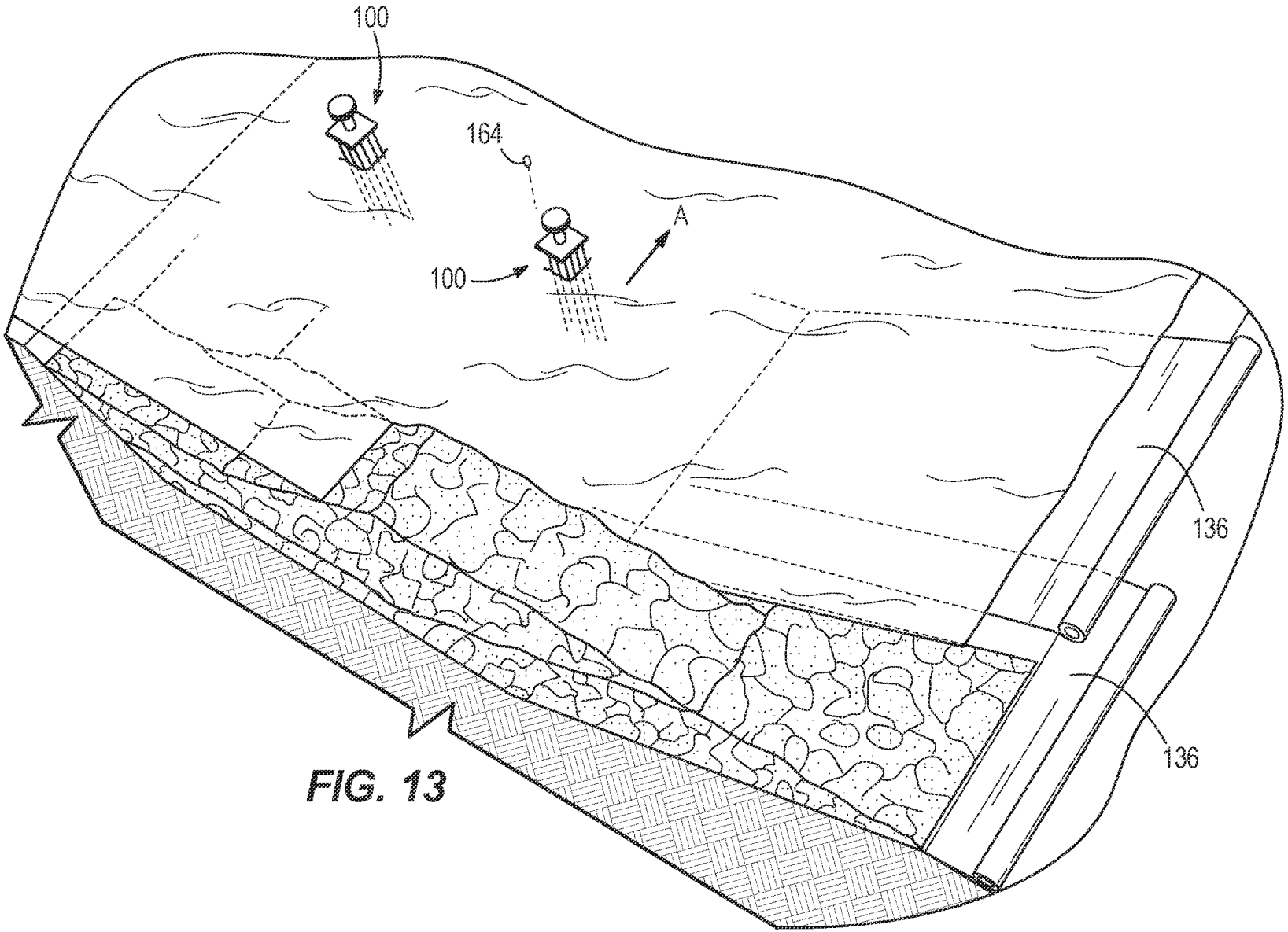
FIG. 13 is a perspective view illustrating the first water-side and first land-side plunger boxes removed, and a second water-side plunger box and second land-side plunger box placed in the underwater trench.

One or more loads of revetment foundation rock are then loaded into the lower box portion 102 of the first land-side plunger box 100 as shown in FIG. 12. First, the bucket 128 can be filled with a load of rock from a nearby supply (e.g., 4-inch to 10-inch bedding stone). The bucket 128 is then positioned against the top portion of the front reinforced fabric panel 142F, and the bucket 128 is manipulated to urge the front reinforced fabric panel 142F against the land-side trench side wall 160C. Just as with the water-side plunger box, this action from the bucket 128 breaks the connection temporarily provided by the wire ties 154 to the front side 106F of the lower box portion 102. The bucket 128 is then manipulated to dump all or part of the rock on the front reinforced fabric panel 142F, for example while still holding the top of the front reinforced fabric panel 142F against the land-side trench side wall 160C. The rock dropped here settles and builds up where the walls 160A, 160B meet. Some of the rock also enters the front compartment of the lower box portion 102 through the front opening 112. If less than all of the first load of rock is put into the front part of the lower box portion 102, a remaining portion can be placed from the bucket 128 into the other (rear) part of the lower box portion 102, rearward of the crossbeam 120. The weight of the first load of rock bears down on both of the reinforced fabric panels 142F, 142B, and not on the plunger box 100, which is bottomless. One or more additional loads of rock of the same or another type can then be placed into the lower box portion 102, if necessary, so that it becomes at least half full, mostly full, or completely full, though not overflowing.

From the configuration of FIG. 12, the working bench may again be expanded so that work can continue further along the construction direction A. If necessary, the water-side toe excavation may be expanded to at least the distance needed for placement of another water-side plunger box 100 alongside the first water-side plunger box 100. Using the first row of plunger boxes 100 and/or buoy(s) 164 as a positional reference, a third plunger box 100 (prepared similarly to the first water-side plunger box 100) is set in place. The third plunger box 100 is the second water-side plunger box 100 and is positioned with one of its lateral sides 106L on top of the projecting portion (projecting from the lower box portion 102 in direction A) of the bottom reinforced fabric panel 142B installed with the first water-side plunger box 100. Minimal spacing distance in the construction direction A may be maintained between the first and second water-side plunger boxes 100. The front panel 142F is then folded down by breaking away the wire ties 154 from the lower box portion 102 on the second water-side plunger box 100. Rock is then loaded into the lower box portion 102 of the second water-side plunger box 100. These steps are carried out similar to the steps already described for the earlier-placed plunger boxes 100 in the first row, and are thus, not repeated in detail. Then, rather than turning immediately to placement of the corresponding land-side plunger box 100 for the second row, the construction equipment can instead be directed back to engage the first water-side plunger box 100, which can be engaged by the bucket 128 and pulled up out of the trench 160, leaving behind the reinforced fabric panels 142F, 142B thereof below the foundation rock resting thereupon. With the first water-side plunger box 100 removed, the construction equipment can be manipulated to spread out the rock in the space vacated by the plunger box. The rock may be spread to a relatively uniform design depth, for example 12 inches. Then, a second rock layer (e.g., filter stone, for example 800 to 1500 pounds each) is placed atop this area of bedding stone to create a platform, maintaining a slope (e.g., about 45 degrees) toward the rear side 106R of the first land-side plunger box 100 and toward the adjacent lateral side 106L of the second water-side plunger box 100 so as to avoid burying them with the additional rock. The depth of the filter stone layer can be about twice the depth of the bedding stone layer in some constructions. Armor stone(s) (e.g., 3 to 7 tons each) are then placed on the resulting platform and stacked to grade, e.g., two stones thick and one to two stones wide. The specific stone layering is mentioned by way of example, and it will be understood that revetments are commonly engineered to different specifications. Thus, some applications may call for more or less bedding stone, no bedding stone, more or less filter stone, filter stone of different size, or multiple differing layers of filter stone for example, according to the project engineer's discretion.

The construction method may continue with further excavation of trench 160, particularly widening of the trench bottom wall 160A and re-sloping of the land-side side wall 160C, prior to any further actions with any of the plunger boxes 100. Then, using the first land-side and second water-side plunger boxes 100 and/or buoy(s) 164 as a positional reference, a fourth plunger box 100 (prepared similarly to the first land-side plunger box 100) is set in place. The fourth plunger box 100 is the second land-side plunger box 100 and is positioned with one of its lateral sides 106L on top of the projecting portion (projecting from the lower box portion 102 in direction A) of the bottom reinforced fabric panel 142B installed with the first land-side plunger box 100. Minimal spacing distance in the construction direction A may be maintained between the first and second land-side plunger boxes 100. The front panel 142F is then folded down by breaking away the wire ties 154 from the lower box portion 102 on the second land-side plunger box 100. Rock (e.g., a layer of bedding stone) is then loaded into the lower box portion 102 of the second land-side plunger box 100. These steps are carried out similar to the steps already described above. Then, rather than turning immediately to placement of the next plunger box 100 (for starting the third row), the construction equipment can instead be directed back to engage the first land-side plunger box 100, which can be engaged by the bucket 128 and pulled up out of the trench 160, leaving behind the reinforced fabric panels 142F, 142B thereof below the foundation rock resting thereupon. With the first land-side plunger box 100 removed, the construction equipment can be manipulated to spread out the rock in the space vacated by the plunger box. As with the steps following pull-out of the first water-side plunger box 100, the rock may be spread to a relatively uniform design depth, for example 12 inches. Then, a second rock layer (e.g., filter stone, for example 800 to 1500 pounds each) is placed atop this area of bedding stone to create a platform, maintaining a slope (e.g., about 45 degrees) toward the adjacent lateral side 106L of the second land-side plunger box 100 so as to avoid burying it with the additional rock. The depth of the filter stone layer can be about twice the depth of the bedding stone layer in some constructions. Armor stone(s) (e.g., 3 to 7 tons each) are then placed on the resulting platform and stacked to grade, e.g., two stones thick and one to two stones wide. The specific stone layering is mentioned by way of example. Once this is completed, the remaining steps are a sequence of repeated steps already described above, beginning with the placement of the next water-side plunger box 100 to begin construction of the third row. The steps are repeated for as many rows are necessary to complete the length of the revetment. Because the plunger boxes 100 can be used over and over again, and are universal for the water and land sides, a minimal supply of plunger boxes 100 is required (e.g., as few as 3), although additional reserves may be kept on hand in the event of damage or simply to speed up the construction process by having additional plunger box(es) 100 being prepared with the reinforced fabric panels 142F, 142B while others are being used in the water.

Various features of the present disclosure are set forth in the following claims.

What is claimed is:

1. A revetment construction apparatus comprising:

a reusable plunger device comprising a box portion having an open bottom and a plurality of sides, including an open front side, a rear side opposite the front side, and a pair of spaced apart lateral sides extending between the front and rear sides, and a mast portion extending vertically upward from the box portion and providing at a top end thereof a picking cap for engagement by a construction machine; and a pair of panels coupled with a movable joint, including a front panel extending along the front side of the box portion and a bottom panel extending along the open bottom of the box portion, wherein each of the front and bottom panels is a reinforced anti-erosion fabric panel coupled to the box portion with breakaway fasteners configured to passively detach from the box portion upon lifting of the reusable plunger device after the box portion has been loaded with revetment foundation rock.

2. The revetment construction apparatus of claim 1, wherein the front and bottom reinforced anti-erosion fabric panels are constructed of a continuous sheet of anti-erosion fabric reinforced by two separate planar sections of structural reinforcing material.

3. The revetment construction apparatus of claim 2, wherein each of the sections of structural reinforcing material is a metal mesh reinforcement layer.

4. The revetment construction apparatus of claim 3, wherein the front and bottom reinforced anti-erosion fabric panels are hingedly coupled with a plurality of loosely fixed wire ties.

5. The revetment construction apparatus of claim 4, wherein the front side of the box portion is taller than the rear side and the pair of lateral sides.

6. The revetment construction apparatus of claim 1, wherein the front and bottom reinforced anti-erosion fabric panels are constructed of a continuous sheet of anti-erosion fabric reinforced by two separate planar sections of structural reinforcing material.

7. The revetment construction apparatus of claim 1, wherein each reinforced anti-erosion fabric panel is reinforced with a metal mesh reinforcement layer.

8. The revetment construction apparatus of claim 1, wherein the front side of the box portion is taller than the rear side and the pair of lateral sides.

9. The revetment construction apparatus of claim 1, further comprising a crossbeam extending between two of the sides of the box portion, the crossbeam subdividing an interior of the box portion into separate compartments.

10. The revetment construction apparatus of claim 9, wherein the mast portion has a bottom end secured to the crossbeam.

11. The revetment construction apparatus of claim 9, wherein the mast portion, the box portion, and the crossbeam are all constructed in majority from a single, uniform material stock.

12. The revetment construction apparatus of claim 1, wherein the breakaway fasteners are twisted wire ties.

13. A method of revetment construction comprising:

providing a reusable plunger device including a box portion and a mast portion extending upward from the box portion, the box portion having an open bottom and a plurality of sides, including an open front side, a rear side opposite the front side, and a pair of spaced apart lateral sides extending between the front and rear sides;

providing a sheet of anti-erosion fabric;

reinforcing the sheet of anti-erosion fabric with a structural reinforcement layer to form a first reinforced fabric panel and a second reinforced fabric panel coupled with the first reinforced fabric panel by a movable joint;

coupling the first and second reinforced fabric panels to the reusable plunger device with breakaway fasteners such that the first reinforced fabric panel extends along the front side of the box portion and the second reinforced fabric panel extends along the open bottom of the box portion; and engaging the mast portion with a piece of construction equipment and manipulating the piece of construction equipment to place the reusable plunger device, with the first and second reinforced fabric panels, into an underwater revetment trench so that the first and second reinforced fabric panels extend, respectively, along a side wall and a bottom wall of the underwater revetment trench.

14. The method of claim 13, further comprising placing at least one load of revetment foundation rock into the box portion onto the sheet of anti-erosion fabric.

15. The method of claim 14, further comprising removing the reusable plunger device from the underwater revetment trench, leaving the revetment foundation rock and the sheet of anti-erosion fabric in place.

16. The method of claim 14, wherein the side wall is a water-side side wall of the underwater revetment trench and the reusable plunger device is a first reusable plunger device, the method further comprising:

providing a second reusable plunger device including a box portion and a mast portion extending upward from the box portion, the box portion having an open bottom and a plurality of sides, including an open front side, a rear side opposite the front side, and a pair of spaced apart lateral sides extending between the front and rear sides;

providing a second sheet of anti-erosion fabric, reinforced with a structural reinforcement layer to form a third reinforced fabric panel and a fourth reinforced fabric panel coupled with the third reinforced fabric panel by a movable joint;

coupling the third and fourth reinforced fabric panels to the second reusable plunger device with breakaway fasteners such that the third reinforced fabric panel extends along the front side of the box portion of the second reusable plunger device and the fourth reinforced fabric panel extends along the open bottom of the box portion of the second reusable plunger device; and engaging the mast portion of the second reusable plunger device with the piece of construction equipment and manipulating the piece of construction equipment to place the second reusable plunger device, with the third and fourth reinforced fabric panels, into the underwater revetment trench so that the third reinforced fabric panel extends along a land-side side wall of the underwater revetment trench and the fourth reinforced fabric panel extends along the bottom wall of the underwater revetment trench, with a portion of the fourth reinforced fabric panel overlapping with a portion of the second reinforced fabric panel on the first reusable plunger device.

17. The method of claim 16, further comprising placing at least one load of revetment foundation rock into the box portion of the second reusable plunger device onto the second sheet of anti-erosion fabric, and placing a third reusable plunger device against the water-side side wall, adjacent the first reusable plunger device, prior to removing the first reusable plunger device from the underwater revetment trench.

18. The method of claim 17, wherein a reinforced fabric panel coupled to the third reusable plunger device is placed so that a portion thereof overlaps a portion of the second reinforced fabric panel on the first reusable plunger device.

19. The method of claim 16, wherein an unreinforced portion of the second sheet of anti-erosion fabric extending from the third reinforced fabric panel is held up out of the water at a position adjacent a top of the land-side side wall during the placement of the second reusable plunger device.

20. The method of claim 14, further comprising, prior to placing the at least one load of revetment foundation rock into the box portion, manipulating the piece of construction equipment to break the breakaway fasteners and fold down the first reinforced fabric panel against the side wall of the underwater revetment trench.

* * * * *